US007339489B2

(12) United States Patent
Arita et al.

(10) Patent No.: US 7,339,489 B2
(45) Date of Patent: Mar. 4, 2008

(54) SENSOR WITH WIRELESS COMMUNICATION FUNCTION

(75) Inventors: Hiroshi Arita, Hitachi (JP); Masaru Kokubo, Hanno (JP); Kenichi Mizugaki, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/786,542

(22) Filed: Feb. 26, 2004

(65) Prior Publication Data

US 2005/0099289 A1 May 12, 2005

(30) Foreign Application Priority Data

Nov. 11, 2003 (JP) ..... 2003-381296

(51) Int. Cl.
*G08B 23/00* (2006.01)

(52) U.S. Cl. ..... 340/693.3; 340/539.1; 455/73

(58) Field of Classification Search ..... 340/521
See application file for complete search history.

(56) References Cited

U.S. PATENT DOCUMENTS

| | | | | |
|---|---|---|---|---|
| 6,605,038 | B1 * | 8/2003 | Teller et al. | 600/300 |
| 2002/0134150 | A1 * | 9/2002 | Shih | 73/146.2 |
| 2005/0017873 | A1 * | 1/2005 | Liu et al. | 340/870.01 |
| 2005/0113035 | A1 * | 5/2005 | Kyongyop O | 455/90.3 |

* cited by examiner

*Primary Examiner*—George Bugg
(74) *Attorney, Agent, or Firm*—Dickstein Shapiro LLP

(57) ABSTRACT

A sensor transmits and receives wireless signals at intervals. A sensor unit, a processor 130, a wireless transmitter circuit, and a wireless receiver circuit are activated in sequence only for a fixed time when the electric power generated by a generator circuit and charged in a capacitor reaches a preset level. Sensing information detected by the sensor unit is processed by the processor circuit and, information on the number of receivable bytes is added to the processing results in the wireless receiver circuit. This added information is sent as sensor information to the wireless host from the wireless transmitting circuit, and the wireless receiver circuit that activated after the wireless transmitter circuit was activated, receives a control information signal from the wireless host. This received information is processed in the processor circuit.

7 Claims, 8 Drawing Sheets

SENSOR WITH WIRELESS COMMUNICATION FUNCTION

FIELD OF THE INVENTION

The present invention relates to a sensor with wireless or radio communication function and in particular relates to a wireless communication function equipped sensor suitable for detecting a physical quantity of detection object, processing the results and transmitting the results by wireless communication to a communication destination.

BACKGROUND OF THE INVENTION

In recent years, wireless (radio) functions have been added to miniature sensors for transmitting information detected by the sensors by wireless communication, and sensor networks formed by connecting these sensors to a network have become the subject of much attention. Such wireless communication function equipped sensor includes a wireless communication function and power supply (battery) inside the sensor unit. Since it has neither wires nor power supply terminals, it can easily be installed in any locations where it was until now impossible to install the sensors.

The wireless communication function equipped sensor uses a battery as a power supply, but it can be provided with a generator for generating electricity from the vibration, light or heat depending on the installation locations to be capable of semi-permanent operation.

Sensor information detected by the wireless communication function equipped sensor is transmitted intermittently at fixed intervals and electric power consumption can be reduced by operating the wireless communication function equipped sensor at intervals. In other words, the wireless communication function equipped sensor is provided with a generator having a small capacity of power supply to reduce the size of sensor. The wireless communication function equipped sensor utilizes such a method that it transmits sensor information for a fixed period of time, when the electric power generated by the generator reaches a level sufficient to drive the wireless communication function equipped sensor. By using this method, even if a generator has a small capacity of power supply, it can transmit sensor information.

An example of sensor which can periodically transmit sensor information is disclosed by Patent document 1. According to Patent document 1, an impeller (shaft with vanes) is installed in water passage and is linked to a generator, which converts the rotational force of the impeller into electric power. The use of water supply is detected by the electric power output from the generator, and an electrical circuit transmits that information by wireless communication.

[Patent document 1] JP-A No. 287818/1999 (See page 2 through page 3, FIG. 1 and FIG. 2).

The prior art technology has proposed a method for transmitting sensor information detected by the wireless communication function equipped sensor wirelessly to communication destination. However, the prior art technology gives no consideration for installing a function to receive information from the communication destination. In other words, there has been a need to provide the wireless communication function equipped sensor with a function for receiving information from the wireless host when changes in the operating mode, installation settings, or program changes were made.

When a function for receiving information is added to the wireless communication function equipped sensor, it is necessary that the receiving circuit is always in standby state to receive information from the wireless host at any time.

However, if a wireless communication function equipped sensor using an internal battery is always in standby state, it will shorten the service life of the battery to cause the troublesome task of changing the battery. Also if the wireless communication function equipped sensor has an internal generator, it is difficult for the sensor to be always in standby state since such generator has only a small capacity of power supply.

SUMMARY OF THE INVENTION

In view of the problems of the prior art, the present invention therefore has the object of providing a sensor that transmits and receives wireless signals at intervals to and from a communication destination.

To achieve the above object, the present invention is comprised of a physical quantity detection device for detecting the physical quantity of a measurement object, a processing device for processing the detection results from the physical quantity detection device, a wireless transmitting device for transmitting the processing results from the processing device to the communication destination, and a wireless receiving device for receiving the wireless signal sent from the communication destination. When the above devices are activation targets, the electric power stored in an electric power storage device for storing electric power generated by self-generation is supplied at intervals to the devices among these activation targets, which are the loads of the electric power storage device.

The present invention is capable of receiving wireless signals from the communication destination without setting the wireless receiving device in standby mode continually, so that electric power consumption can therefore be drastically reduced.

DETAILED DESCRIPTION OF THE PREFERRED EMBODIMENTS

Figure 1:
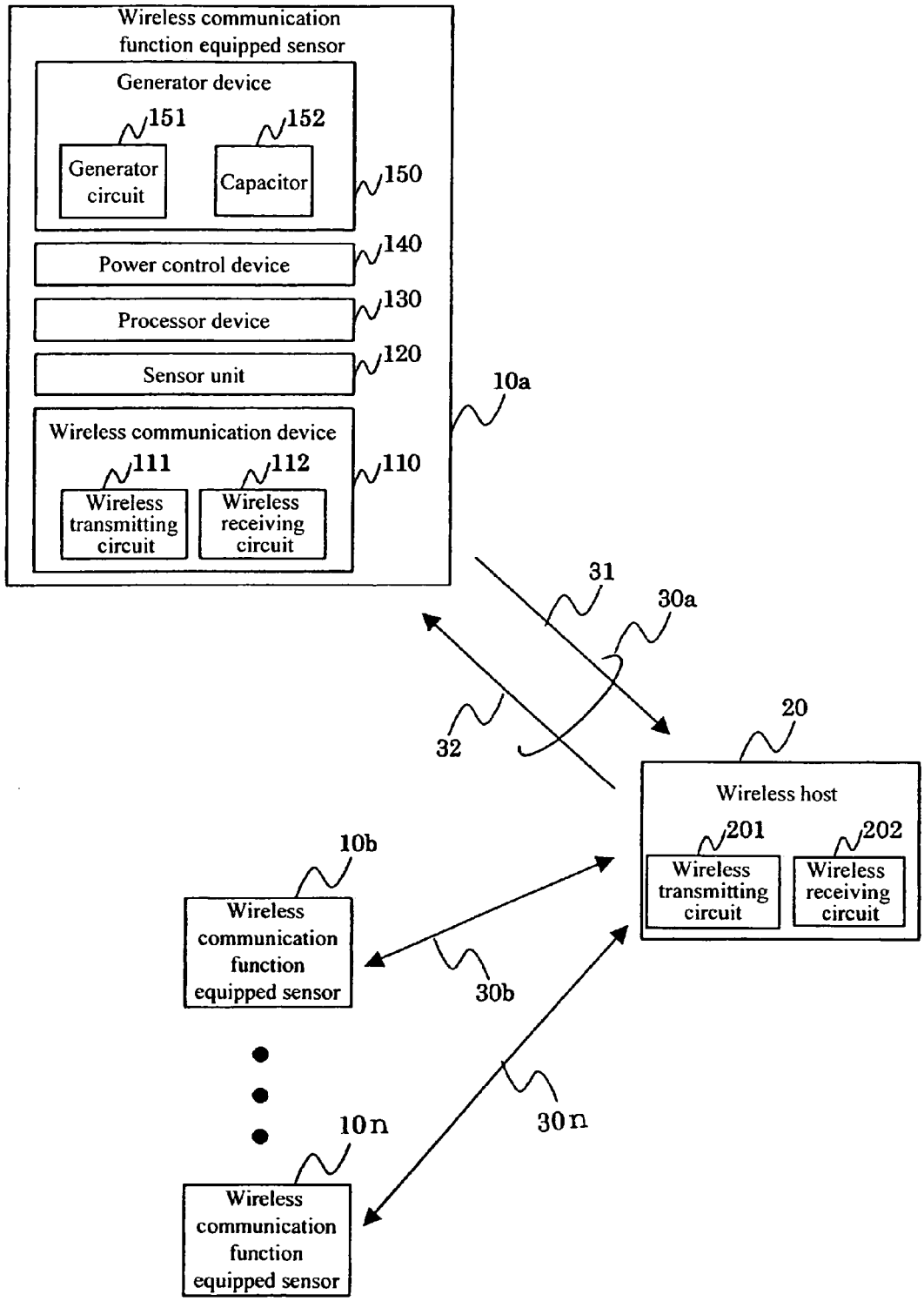
FIG. 1 is a block diagram showing an embodiment of the sensor system comprised of a wireless host and the wireless communication function equipped sensor of the present invention.

The preferred embodiments of the present invention are described next while referring to the drawings. FIG. 1 is a block diagram showing an embodiment of the sensor system when a network system is formed by a wireless host and wireless communication function equipped sensors of the present invention. As shown in FIG. 1, the sensor system is comprised of a plurality of wireless communication function equipped sensors 10*a*, 10*b*, . . . , 10*n* and, a wireless host 20. The wireless communication function equipped sensors 10*a* through 10*n* and the wireless host 20 transmit and receive information by utilizing wireless communication signals 30*a*, 30*b*, . . . , 30*n*. Each of the wireless communication function equipped sensors 10*a* through 10*n* has an identical structure and function. The specific structure of the wireless communication function equipped sensor 10*a* is hereafter described and is referred to as the wireless communication function equipped sensor 10.

The wireless communication function equipped sensor 10 is comprised of a wireless communication device 110, a sensor unit 120, a processor device 130, a power control device 140 and a generator device 150. The wireless communication device 110 includes a wireless transmitting circuit 111 as a wireless transmitting device for transmitting the wireless communication signal 30*a* to the wireless host 20 as a communication destination, and a wireless receiving circuit 112 as a wireless receiving device for receiving the wireless communication signals 30*a* from the wireless host 20. The generator device 150 includes a generator circuit 151 as a generating device for generating electric power by self-generation, and a capacitor 152 as an electric power storage device for charging power generated by the generator circuit 151.

On the other hand, as a wireless signal transmitting/receiving device, for transmitting and receiving the wireless communication signals 30*a* to and from the communication sensor 10, the wireless host 20 includes a wireless transmitting circuit 201 for transmitting wireless communication signals 30*a* to the wireless communication function equipped sensor 10; and a wireless receiving circuit 202 for receiving wireless communication signal 30*a* from the wireless communication function equipped sensor 10. The wireless receiving circuit 202 is always in a standby state. The wireless communication signals 30*a* (hereafter referred to as wireless communication signals 30) is comprised of a sensor information signal 31 including sensing information (sensor information) detected by the sensor unit 120 and a control information signal 32 including setting information for the wireless communication function equipped sensors 10 and control information such as update information on programs running on the processor device 130.

When exchanging information between the wireless communication function equipped sensors 10 and wireless host 20 by using the wireless communication signals 30, the wireless host 20 exchanges information simultaneously with a plurality of wireless communication function equipped sensors 10. A communication method is therefore employed to prevent communication interference during simultaneous communication between a plurality of wireless communication function equipped sensors and the wireless host 20.

More specifically, when the wireless communication function equipped sensor 10 transmits the sensor information signals 31 to the wireless host 20, the communication sensor 10 and wireless host 20*a* utilize a UWB (Ultra Wide Band) communication method. When the wireless host 20 transmits the control information signals 32 to the wireless communication function equipped sensors 10, the wireless communication function equipped sensor 10 and wireless host 20*a* utilize any one of AM (amplitude modulation), FM (frequency modulation), or infrared (IrDA) communication methods.

Figures 2A, 2B:
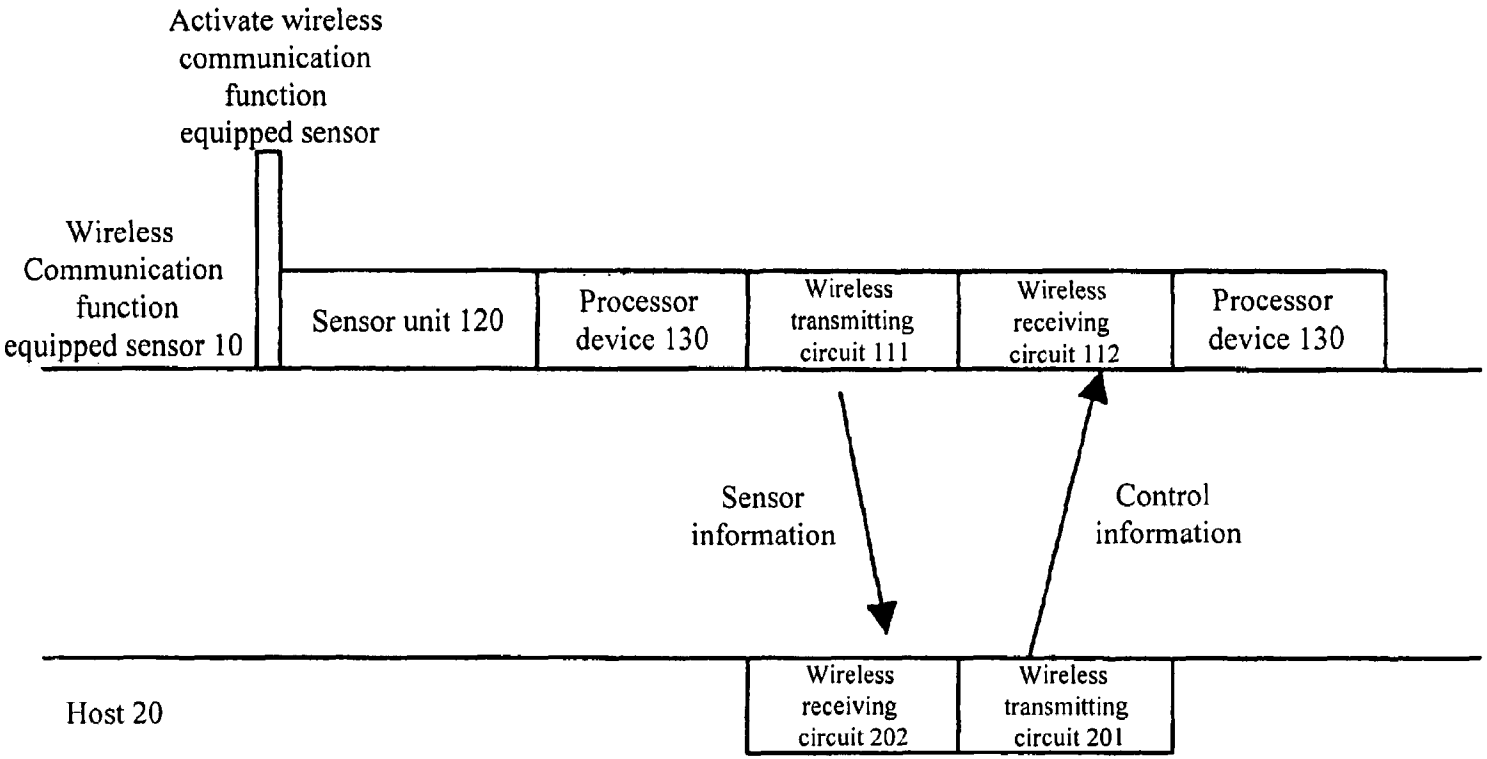
FIG. 2 is a chart showing a method of the communication process between the wireless host and the wireless communication function equipped sensor of the present invention.

The power consumption by the wireless communication function equipped sensor 10 must be controlled as less as possible when transmitting and receiving information between the wireless communication function equipped sensor 10 and wireless host 20 using the wireless communication signals 30. Therefore, in the present embodiment, as shown in FIG. 2, the power control device 140 monitors if the electric power charged in the capacitor 152 is sufficient or not for activating or operating all the devices constituting the electric load for the capacitor 152. When power control device 140 determines that power charged in the capacitor 152 has reached a level capable of activating or operating devices constituting the load of the capacitor 152, the electric power charged in the capacitor 152 serves as a power supply and supplies power at intervals in sequence to activate the sensor unit 120, the processor device 130, the wireless transmitting circuit 111, and the wireless receiving circuit 112. In this case, the wireless host 20 immediately transmits the wireless communication signals 30 from the wireless transmitting circuit 201 to the wireless communication function equipped sensor 10 under the condition that the wireless receiving circuit 202 has received the wireless communication signals 30. The wireless receiving circuit 112 then promptly receives these wireless communication signals 30.

The wireless receiving circuit 112 can also be activated in an overlap state with the wireless transmitting circuit 111. In other words, after the wireless transmitting circuit 111 has been activated, the wireless receiving circuit 112 can be activated after the time required for transmitting and receiving the wireless communication signals 30 has elapsed. When the wireless transmitting circuit 111 and the wireless receiving circuit 112 are to be activated, by providing a time band at which they are partially overlapped by each other, it can shorten the time required for the wireless transmitting circuit 111 and wireless receiving circuit 112 to be activated.

Figure 3:
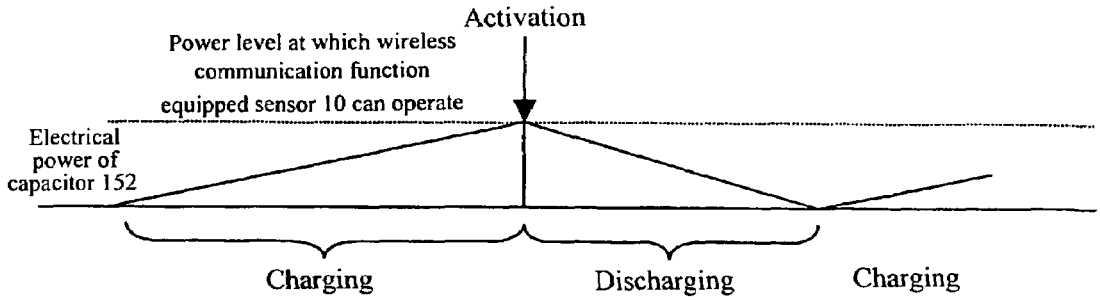
FIG. 3 is a drawing showing the transition in electric power charging in the capacitor in the generator device within the wireless communication function equipped sensor.
Figure 4:
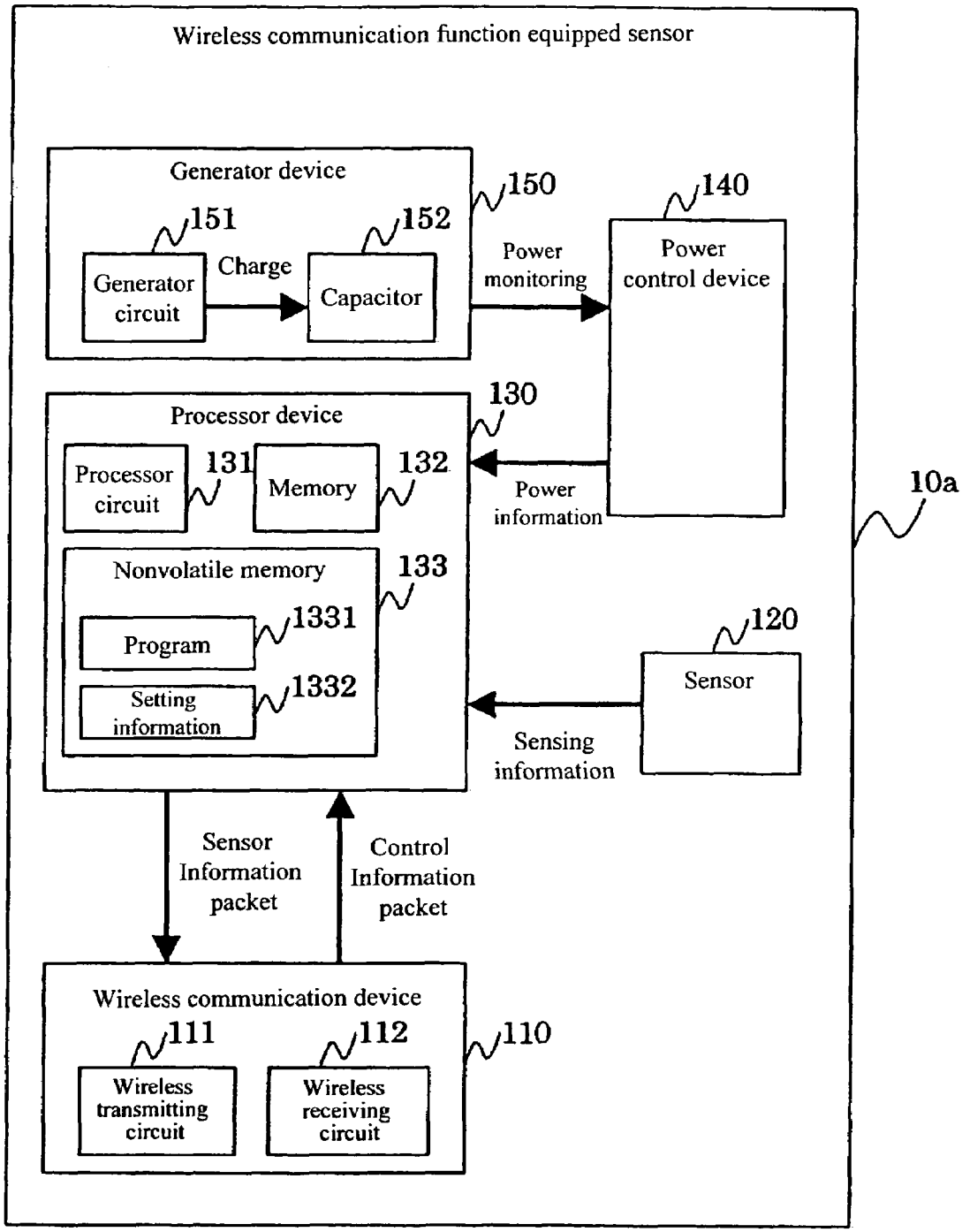
FIG. 4 is a block diagram showing in more detail the structure of the wireless communication function equipped sensor of the present invention.

The structure of each section of the wireless communication function equipped sensor 10 is described next in detail. The generator circuit 151 in the generator device 150 is configured to perform self-generation by using vibration, light or heat as the energy for power generation. This generator circuit 151 always generates electricity but the amount of generation (amount of power) is small and not enough to constantly operate all the devices in the wireless communication function equipped sensor 10. The electric power generated by the generator circuit 151 is therefore charged in the capacitor 152. In other words, the capacitor 152 is charged with the electric power generated by the generator circuit 151. As shown in FIG. 3, electrically power is sequentially charged in the capacitor 152 as the amount of generation by the generator circuit 151 increases. When this charged electric power reaches such a level that all the devices constituting the load of the capacitor 152 can be activated or operate, the power control device 140 supplies power to each load in sequence, and the electric power charged in the capacitor 152 is gradually discharged. After the electric power charged in the capacitor 152 has been discharged, and the devices constituting the load of capacitor 152 has stopped, the charging of capacitor 152 starts again together with power generation in the generator circuit 151. Such a cycle continually repeats.

The sensor unit 120 is comprised of, for example, an acceleration sensor, a heat sensor, a gas sensor as a physical detection device for detecting physical quantities of detection target. The physical quantity detected by the sensor unit 120, for example, a physical quantity relating to acceleration speed, heat or gas is converted into electrical signals indicating sensing information and input to the processor device 130.

The processor device 130 is comprised of a processor circuit 131, a memory 132, and a nonvolatile memory 133, as a processing device for processing the sensing information detected by the sensor units 120, packetizing the processing results into sensor information packets and outputting them to the wireless communication device 110. The nonvolatile memory 133 includes a program 1331 and setting information 1332. In other words, in the processor device 130, the program 1331 inside the nonvolatile memory 133 is run by the processor circuit 131. Here, the number of receivable bytes (receivable time) is calculated by using information from the setting information 1322 and memory 132 based on sensing information of detection signals from the sensor unit 120, and electric power information from the power control device 140. Sensor information packets are made according to these calculated results and these sensor information packets are then output to the wireless communication device 110. The processor device 130 extracts the setting information and program information from the control information packet input by the wireless communication device 110 and based on this information, updates the setting information 1332 and the program 1331 in the nonvolatile memory 133.

The wireless communication device 110 includes a wireless transmitting circuit 111 as a wireless transmitting device for transmitting sensing information signals 31 as the wireless communication signals 30 to the wireless host 20 as a communication destination. The wireless communication device 110 also includes a wireless receiving circuit 112 as a wireless receiving device for receiving the control information signals 32 as the wireless communication signal 30 from the wireless host 20. Information relating to the number of receivable bytes (receivable time) by the wireless communication function equipped sensor 10 is added to the sensor information packet sent from the wireless transmitting circuit 111 to the wireless host 20 for the reason of usage of electric power. The number of transmittable bytes (transmittable time) as bytes of information that should be sent to the wireless communication function equipped sensor 10 is in this way conveyed to the wireless host 20.

Figure 5:
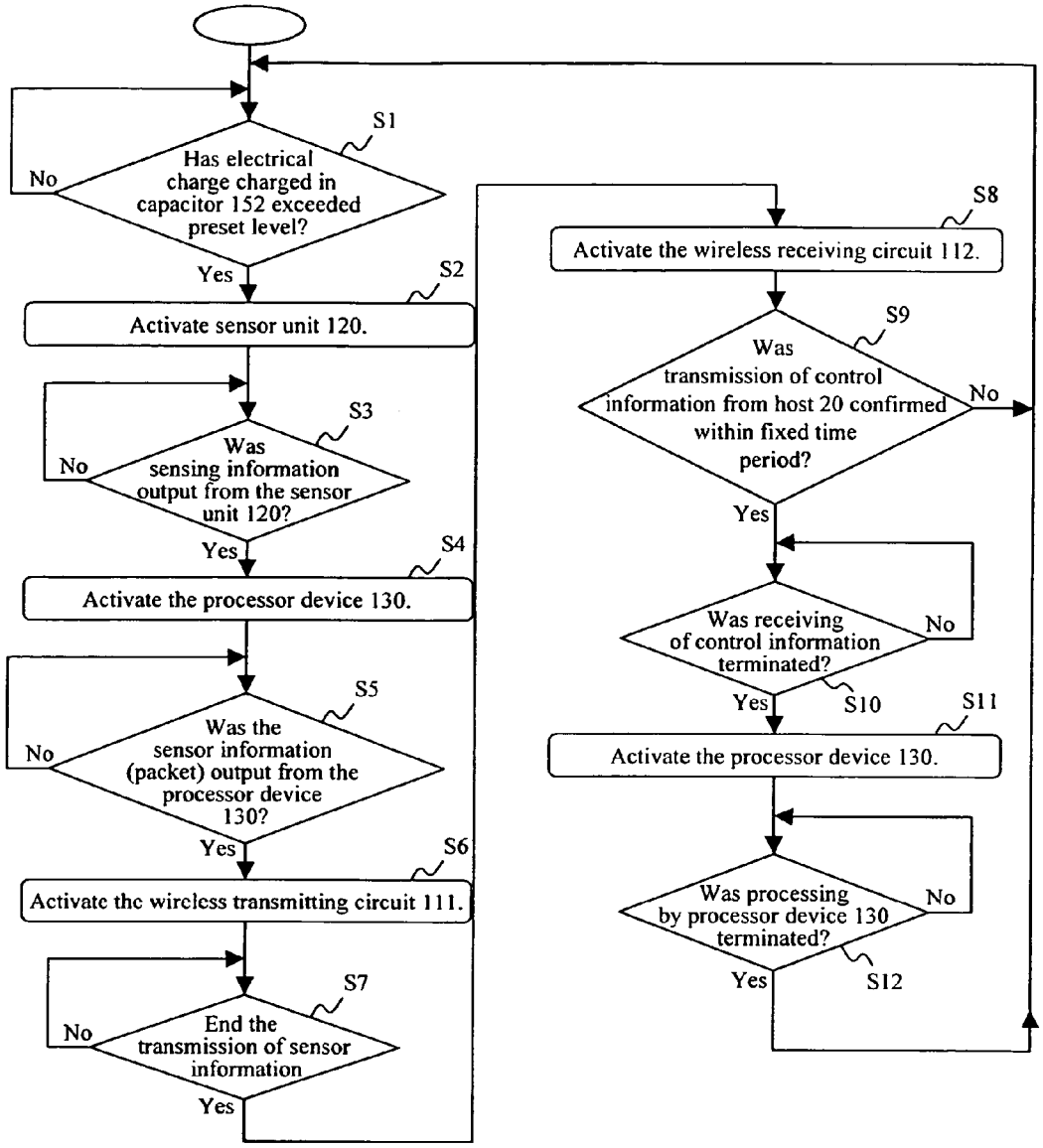
FIG. 5 is a flow chart for describing the process of the power control device within the wireless communication function equipped sensor of the present invention.

Overall operation of the wireless communication function equipped sensor 10 is controlled by the power control device 140 that serves as a power control device for supplying electric power charged in the capacitor 152 to the devices as the loads of the capacitor 152 and controlling the activation of the load intermittently. The processing method of the power control device 140 is next described in detail using the flowchart of FIG. 5. The power control device 140 monitors the electric power charged in the capacitor 152 of the generator device 150. Until the electric power level charged in the capacitor 152 reaches a power level required for processing in the wireless communication function equipped sensor 10 or an electric power level required for operating all the loads of capacitor 152, the power control device 140 stops the operations of the sensor units 120 and the processor device 130 to suppress any unnecessary electric power consumption (step S1).

The power control device 140 first of all activates the sensor unit 120 (step S2) when the electric power level charged in the capacitor 152 reaches a preset power level or a power level capable of operating the wireless communication function equipped sensors 10. The processor device 130 then is activated (step S3, S4) when sensing information is output from the sensor unit 120 accompanying the activation of the sensor unit 120. A decision is then made (step S5) whether or not sensor information packets have been output from the processor device 130 to the wireless communication device 110. When sensor information packets are output from the processor device 130, the wireless transmitting circuit 111 is activated (step S6). The sensor information packets are sent to the wireless host 20, and a decision is made whether or not the transmission of sensor information is ended (step S7). At this time, the processor device 130 obtains information on the electric power remaining in the capacitor 152 and based on this information calculates the number of receivable bytes (receivable time). These calculated results are added to the sensor information. The wireless receiving circuit 112 is activated when transmission of all the sensor information is completed, and shifts to a standby state for receiving the wireless communication signals 30 from the wireless host 20. A decision is then made whether or not the wireless communication signals 30 have been received from the wireless host 20 within a fixed amount of time (step S9). At this time, after the wireless receiving circuit 112 has been activated, if the control information signals 32 are not received from the wireless host 20 within a fixed amount of time and the transmission of the wireless information signals 32 from the wireless host 20 is not confirmed, the receiving processing is terminated and the processing returns to step S1. However, when confirmed that the wireless receiving circuit 112 has received the control information signals 32, a decision is made if all the control information signals 32 have been received or not (step S10). When all the control information signals 32 have been received, the processor device 130 once again is activated for a fixed amount of time, and the wireless receiving circuit 112 outputs the contents (control data) of the received control information signals 32 to the processor device 130 (step S11). The processor device 130 then analyzes this received control data, and when processing in the processor device 130 is finished, the process returns to step S1 (step S12).

When the electric power charged in the capacitor 152 has reached a level capable of activating the loads on capacitor 152, the processor device 130 functions as a processing device to calculate the data quantity (bytes) which can be received by the wireless receiving circuit 112 or the time in which the wireless receiving circuit 112 can receive the wireless signal, based on the electric power charged in the capacitor 152, adds the calculated results to the processing results and outputs them as sensor information.

The wireless receiving circuit 202 of wireless host 20 is always in a standby state, awaiting the transmission of sensor information signals 31 from a plurality of wireless communication function equipped sensors 10. If the wireless host 20 has control information to be sent to the wireless communication function equipped sensors 10, the wireless host 20 transmits the control information to the wireless communication function equipped sensors 10 after receiving the packet including sensor information sent from the wireless communication function equipped sensor 10. When the wireless host 20 receives the sensor information (sensor information signals 31) from the wireless communication function equipped sensor 10, the wireless host 20 checks the information within the received packets, or the number of bytes receivable by the wireless communication function equipped sensor 10. Here, when the control information to be sent is greater than the number of bytes that the wireless communication function equipped sensor 10 can receive, the control information is divided, and converted into packets so that the divided information falls within the number of bytes. The converted control information is sent as segments at a certain number of times to the wireless communication function equipped sensor 10.

By employing this method in the wireless host 20, the standby time in wireless communication function equipped sensor 10 is merely the time until the control information signal 32 arrives from the wireless host 20 so that the receiving standby time can therefore be drastically reduced. Also, by transmitting information regarding bytes receivable by wireless communication function equipped sensor 10 to the wireless host 20, the wireless host 20 can send just a portion of data that the wireless communication function equipped sensor 10 can receive. In this way, the interruption of receiving signals or receiving failures because control information signal 32 is long and the wireless communication function equipped sensor 10 does not have enough power can be prevented.

Figure 6:
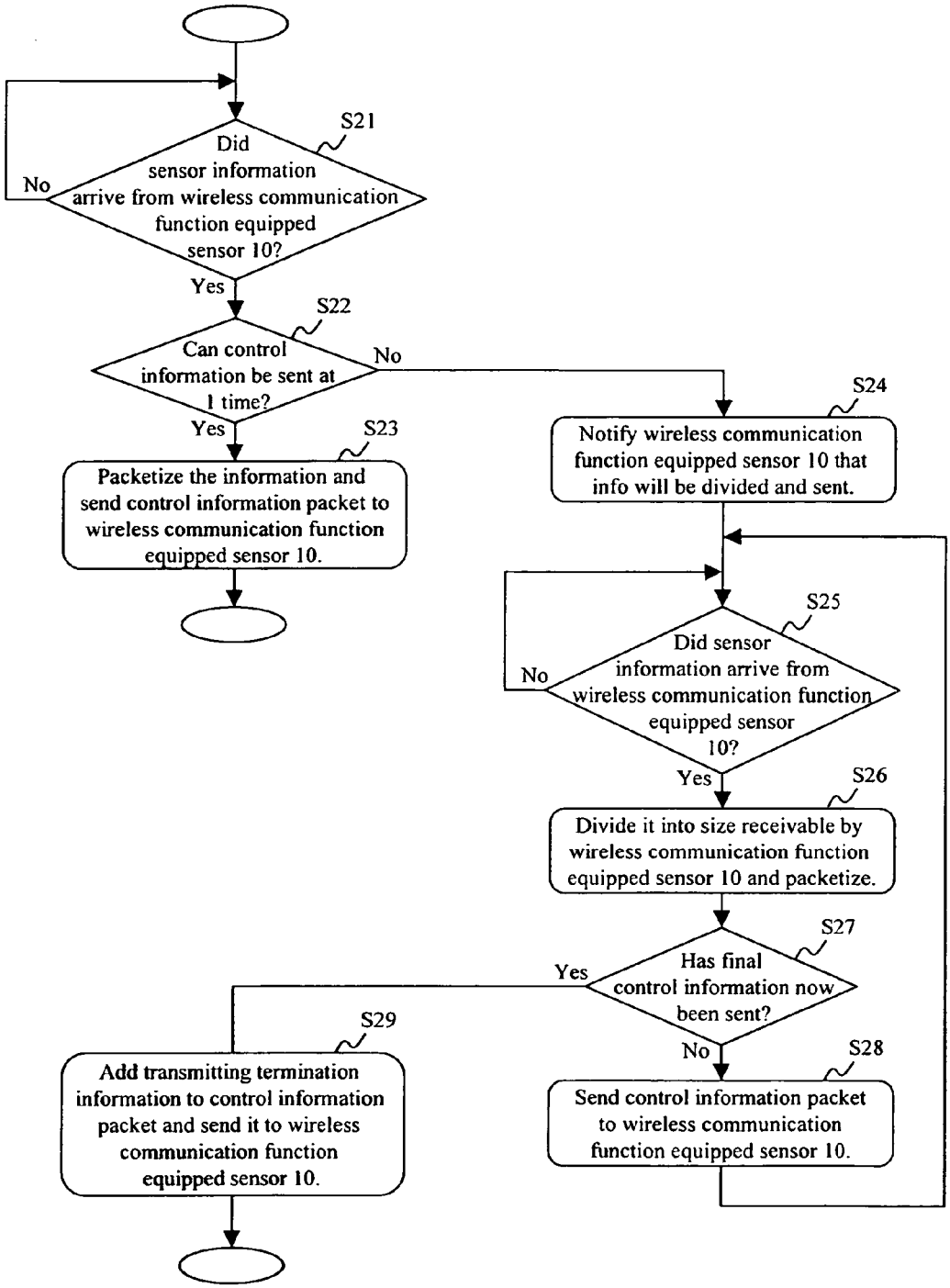
FIG. 6 is a flow chart for describing a method of the communication process of the wireless host of the present invention.
Figure 7:
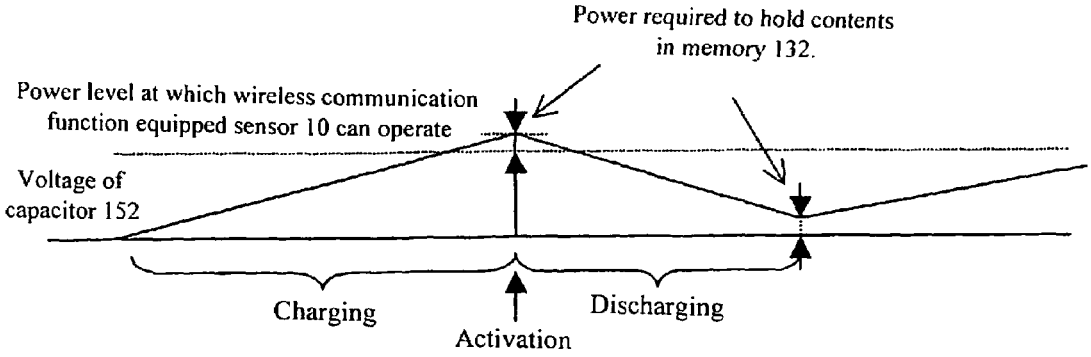
FIG. 7 is a drawing describing the interrelation of electric power charged in the capacitor and electric power required to hold the contents of the memory within the wireless communication function equipped sensor of the present invention.

The processing when transmitting the control information as segments from the wireless host 20 to the wireless communication function equipped sensor 10 is described next using the flow chart in FIG. 6. When transmitting the control information to the wireless communication function equipped sensor 10, the wireless host 20 first of all determines whether or not packet information has been received from the wireless communication function equipped sensor 10 (step S21). When the sensor information has been received, the number of bytes that the wireless communication function equipped sensor 10 can receive is obtained from information added to the sensor information and is analyzed. From the analysis results, the wireless host 20 determines whether or not the control information can be sent at one time (step S22). When determined that the control information can be sent at one time, or in other words when the size receivable by the wireless communication function equipped sensor 10 is greater than the size of the control information, then the wireless host 20 packetizes the control information, and transmits the packetized control information to the wireless communication function equipped sensor 10 (step S23). Remaining electric power is in this case used in the next transmission of sensor information.

However, when the wireless host 20 determines that the control information cannot be sent at one time, or in other words when the size receivable by the wireless communication function equipped sensor 10 is smaller than the size of the control information, then first of all, the wireless host 20 notifies to the wireless communication function equipped sensor 10 that the control information will be divided before sending (step S24). The purpose of this notification is to allow the wireless communication function equipped sensor 10 to prepare to hold the control information to be sent in segments, since the wireless communication function equipped sensor 10 cannot update the program and setting information before all the control information is received from the wireless host 20. After this notification, the wireless host 20 determines whether or not the sensor information has been sent from the wireless communication function equipped sensor 10 (step S25). If the sensor information has been received, the control information to be sent is divided up into sizes receivable by the wireless communication function equipped sensor 10, and this divided control information is packetized and sent to the wireless communication function equipped sensor 10 (step S26). Afterwards, the wireless host 20 determines whether or not all the control information has been sent (step S27). If not, the divided information is packetized and sent (step S28) and the processing continues from step S25 through step S28. However, if it is determined that all the control information has been sent, then terminating information is added to the final control information packet and sent to the wireless communication function equipped sensor 10 and the processing in this routine ends (step S29).

By setting the data size receivable by the wireless communication function equipped sensor 10 at the head of the sensor information packet sent to the wireless host 20 from the wireless communication function equipped sensor 10, the wireless host 20 can create the control information packets to be sent, while receiving sensor information packets from the wireless communication function equipped sensor 10. After receiving the sensor information packet, the wireless host 20 can promptly send control information packets to the wireless communication function equipped sensor 10.

On the other hand, when the wireless communication function equipped sensor 10 has received control information packets, it updates the program 1331 and the setting information 1332 based on that control information after receiving all the control information. There are two methods for holding this divided control information. One method is to write the received divided control information into the nonvolatile memory 133 and then update it after all the control information is received. Another method is hold the received divided control information in the memory 132 and then update it after all the control information is received.

When information is written into the nonvolatile memory 133, a certain amount of electric power is required. However, power is not required to hold the written contents. When information is written into the memory 132, power is required to hold the written contents. The power control device 140 therefore delays activation of the wireless communication function equipped sensor 10 until electric power has been charged sufficient to hold the contents of the memory 132 in addition to the electric power required to activate the wireless communication function equipped sensor 10. By this type of processing, sufficient electric power to hold the contents of the memory 132 can be obtained even if the power in the capacitor 152 has been used due to activating the wireless communication function equipped sensor 10.

By utilizing the above methods, settings of the wireless communication function equipped sensor 10 and programs for the wireless communication function equipped sensor 10 can be easily changed.

Figure 8:
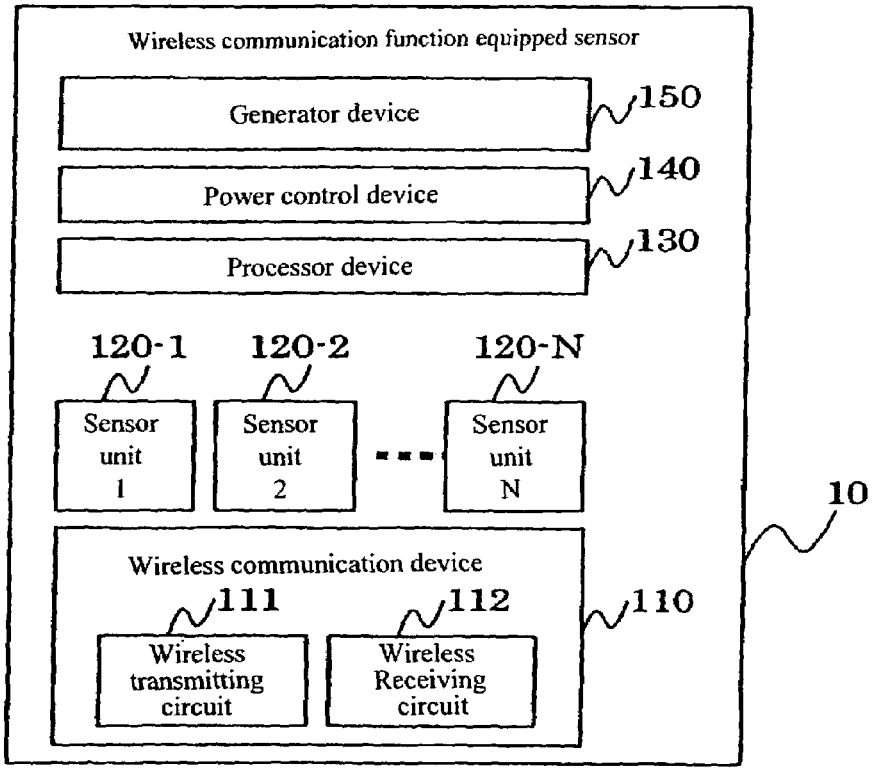
FIG. 8 is a block diagram showing the wireless communication function equipped sensor having a plurality of sensor units of the present invention.

More specifically, as shown in FIG. 8, when a plurality of sensor units 120 consisting of sensor units 12-1 tot 120-N are installed in one wireless communication function equipped sensor 10, by sequentially switching and inputting the sensing information based on instructions from the processor device 130, different kinds of checks can be performed depending on the number of sensor units 120 without using a plurality of wireless communication function equipped sensors 10. In other words, different kinds of examinations can be performed by using the sensor units 120 to detect the different physical quantities. Furthermore, when N number of sensor units 120 are configured to have an identical structure, then even if one of sensor units 120 becomes defective, its operation can be switched to another correctly functioning sensor unit 120 so that the service life of the wireless communication function equipped sensor 10 can be extended. In this case, the switching or selection of the sensor units 120 can be performed according to control information from the wireless host 20 as changes in the operating mode.

The application of this system comprising a wireless communication function equipped sensor 10 and the wireless host 20 to a method for detecting aged concrete is described next. Aging or weakening of concrete has become an important problem in terms of concrete peeling or separating in bridge supports and damage due to recent earthquakes, etc. The strength of the concrete can be detected by the PH value indicating the alkaline or acid level. Concrete initially has weak alkalinity but becomes more neutral and acidic with age and becomes brittle. However, if the strength of the concrete is measured, the concrete should be peeled away to examine the inside of the concrete, because the PH value cannot be determined from the outside of the concrete. Accordingly, it is extremely difficult and troublesome to perform examination of concrete periodically.

Figure 9:
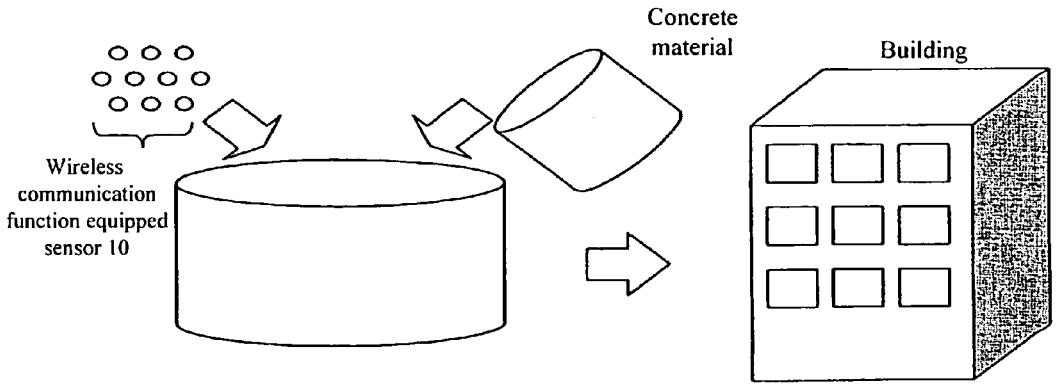
FIG. 9 is a system diagram showing a method for applying the wireless communication function equipped sensor of the present invention in a concrete aging detection system.

Therefore, wireless communication function equipped sensors 10 containing PH sensors are mixed into the concrete material such as cement during construction of the building or bridge supports as shown in FIG. 9 to produce the concrete containing the wireless communication function equipped sensors 10. These pre-installed sensors are extremely advantageous in terms of cost and strength compared to embedding sensors 10 into the concrete after it has hardened. In these cases, the wireless communication function equipped sensors 10 are buried inside the concrete and therefore it is impossible to access them directly by connecting an external terminal to the outside of concrete. It is also impossible to replace the wireless communication function equipped sensors 10 and therefore, the wireless communication function equipped sensors 10 must be able to operate for a period of dozens of years. However, a wireless communication function equipped sensor 10 having electrical generating and wireless receiving functions and adjustable by wireless communication will prove effective in those cases.

In other words, if a building is constructed with concrete material containing the wireless communication function equipped sensors 10 with PH sensors, the generator device 150 of the wireless communication function equipped sensor 10 can generate electricity without directly connecting the building with a terminal from the outside of the building. In a concrete aging detection system for example, a PH sensor is utilized as the sensor unit 120 used in the wireless communication function equipped sensor 10, and the generator device 152 uses a vibration-generating method by which electric power is generated by for example the tiny vibration of air-conditioning equipment or elevator.

Further, it is necessary to consider manufacture, construction and disposition in the concrete aging detection system.

More specifically, in order to correctly communicate between the wireless host 20 installed in each room or floor in the building and the wireless communication function equipped sensors 10 embedded in concrete, it is necessary to adjust the strength of the sensor information signal 31 sent by each wireless communication function equipped sensor 10 as well as the sensitivity of the sensor unit 120.

It happens occasionally that the wireless communication function equipped sensors 10 cannot generate electricity for these adjustments. For example, in case of inspection on sensor lines at a factory, or, due to current construction work, the desired vibration cannot be obtained even after sensors have been installed. The wireless communication function equipped sensors 10 may use vibration that normally do not occur. For example when a machine is generating vibration as warning signs of a breakdown, the wireless communication function equipped sensors 10 use such vibration.

Figure 10:
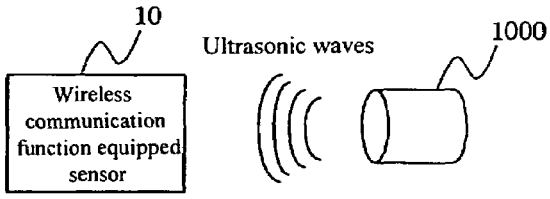
FIG. 10 is a drawing showing a method for generating electric power in the generator device in the wireless communication function equipped sensor by using an ultrasonic wave generator.

In the present embodiment as shown in FIG. 10, an ultrasonic generator device 1000 may be used to emit sound waves or ultrasonic waves with a frequency identical to the resonant frequency of the generator circuit 151 of wireless communication function equipped sensor 10. The generator circuit 151 generates electric power in response to the ultrasonic waves emitted from the ultrasonic generator device 1000. This ultrasonic generator device 1000 can emit ultrasonic waves even if the wireless communication function equipped sensors 10 with the PH sensors are embedded within the building and the generator circuit 151 within the building can therefore generate electric power so that sensor adjustments and operational tests can be performed.

This method is effective even when performing tests during manufacture of the wireless communication function equipped sensors 10 or periodic diagnostic checks of the wireless communication function equipped sensor 10. Furthermore, by using this method, it is possible to confirm whether or not the wireless communication function equipped sensor 10 is actually operating correctly from the generation of electric power to the transmission of sensor information, without adding a function to switch modes for performing a test mode, etc. Besides a method for generating electric power from ultrasonic waves, the generator circuit 151 may also utilize a method for generating electric power in response to ultraviolet rays or a magnetic field.

Even if the wireless communication function equipped sensor 10 has not a transmitting function, the above methods will prove effective in tests during manufacture and periodic inspections, since sensor information can be sent if artificial vibrations are supplied in the same way.

A method can be used to adjust the sensor information signals output from the wireless communication function equipped sensor 10 according to the particular RF (radio wave) environment. These are needed for example, when the building or bridge supports have been completed and then are used. In other words, the wireless communication function equipped sensors 10 and wireless host 20 perform wireless communication and so are easily susceptible to effects from the local RF (radio wave) environment. It is necessary to suppress the output of sensor information in order to reduce power consumption. However, normal communication might become impossible when communication errors occur due to long distances between the wireless communication function equipped sensors 10 and wireless host 20, or due to temporary strong external RF interference.

In these cases, normal communication in real-time can be performed according to circumstances, by using control information sent from the wireless host 20 to adjust the sensor information signal output from wireless communication function equipped sensor 10.

Figure 11A:
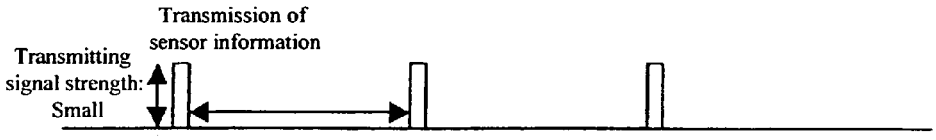
FIG. 11 is a drawing showing a method for adjusting the transmission interval of sensor information according to the transmission intensity.
Figure 11B:
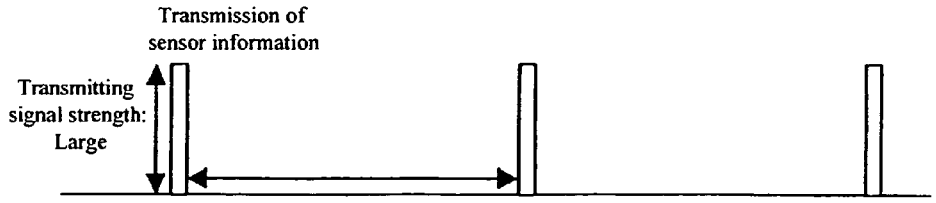

More specifically as shown in FIG. 11, intervals of transmission of the sensor information can be adjusted according to the strength of the transmission signal by changes in operating mode by the processor device 130 since the electric power generated by the generator device 150 is the same. If, for example, the sensor information output is small and the transmission strength is small, the transmission intervals can be shortened so that the communication between the wireless communication function equipped sensors 10 and wireless host 20 can continue without interruptions. On the other hand, when the sensor information output is large and the transmission strength is large, transmission intervals can be set longer so that communication between the wireless communication function equipped sensors 10 and wireless host 20 can continue without interruptions.

Even when the wireless host 20 is to be changed because the wireless communication function equipped sensor 10 has been moved or because the sensor information signal is reflected by an obstructing object to prevent communication with the specified wireless host 20, the switching between wireless hosts 20 can be performed smoothly by adjusting the transmission strength and transmission intervals.

According to the present embodiment, when wireless communication function equipped sensors 10 are discarded, a method is used for stopping the operation of such wireless communication function equipped sensors 10, which have been determined as defective by periodical inspections, or which have been contained in concrete that is no longer needed when disposal or reclaiming of buildings or bridge supports.

Sensor information sent from wireless communication function equipped sensors 10 that are no longer needed might adversely effect other equipment. Accordingly, wireless communication function equipped sensors 10 that are no longer needed are discarded and their operation are stopped.

In those cases, the functions of the wireless communication function equipped sensors 10 are stopped by the wireless host 20 transmitting control information to the wireless communication function equipped sensors 10 instructing that operation to be stopped. For example, receiving a stop command from the wireless host 20, the wireless communication function equipped sensor 10 performs short-circuit of the output of generator circuit 151 to destroy it, thereby stopping it's operation. Other methods are to stop the power control circuit 140, processor device 130 or wireless device 110. By stopping the operation of these components, the wireless communication function equipped sensor 10 can not transmit wireless information so that the functions of that wireless communication function equipped sensor 10 will be disabled.

The functions of wireless communication function equipped sensor 10 can temporarily be stopped by stopping only the operation of the wireless transmitting circuit 111. By stopping only the wireless transmitting circuit 111, the wireless communication function equipped sensor 10 does not transmit sensor information to reduce unnecessary transmissions of RF (radio waves) signals.

However, since the generator device 150, power control device 140 and processor device 130 are operating, only the wireless receiving circuit 112 is activated when an electrical charge capable of activating the wireless communication function equipped sensor 10 is charged in the generator device 150. Therefore, if the wireless transmitting circuit 201 of wireless host 20 continually transmits activation requests, the wireless communication function equipped sensor 10 will receive such activation requests from the wireless host 20 to activate the wireless transmitting circuit 111.

The operation of the wireless communication function equipped sensor 10 can in this way be restarted.

A wireless communication function equipped sensor 10 having a receiving function as described above, allows adjustments and responses to be made in real time and is therefore extremely convenient to use.

In the above embodiment, during communications between the wireless communication function equipped sensor 10 and wireless host 20, the wireless host 20 transmits control information immediately after it has received the sensor information signals 31 from the wireless communication function equipped sensor 10 so that the wireless communication function equipped sensor 10 can receives the control information signals 32 from the wireless host 20 without standby state. Power consumption in the wireless communication function equipped sensor 10 is therefore drastically reduced, and the wireless communication function equipped sensor 10 can be activated by the generator device 150 inside.

Also, the wireless communication function equipped sensor 10 notifies the wireless host 20 of the amount of receivable bytes (receivable time) when transmitting sensor information. Therefore when the size of the control information data is large, the wireless host 20 can send that control information in segments, so that the control information can be reliably sent to the wireless communication function equipped sensor 10.

The wireless communication function equipped sensor 10 is therefore extremely convenient to use and manage since adjustments can be made from outside via wireless communication without a direct connection to a terminal and without external wiring; and adjustments and program changes are easily made on-site after installation of the wireless communication function equipped sensor 10. It is easy to change the strength of sensor information signal of the wireless communication function equipped sensor 10, or to stop transmissions when discarding the sensor in real time and therefore the wireless communication function equipped sensor 10 is extremely convenient to use.

What is claimed is:

1. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals;

a wireless receiving device which receives wireless signals from said wireless communication device; and a power control device which supplies the electric power charged by said electric power charging device to said load devices, wherein said load devices are activated when the electric power charged by said electric power charging device reaches a level sufficient to activate said load devices, wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated.

2. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals;

a wireless receiving device which receives wireless signals from said wireless communication device; and a power control device which supplies sequentially the electric power charged by said electric power charging device to said load devices, when the electric power charged by said electric power charging device reaches a level sufficient to activate said load devices, wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated.

3. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals;

a wireless receiving device which receives wireless signals from said wireless communication device, wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated wherein said processing device calculates an amount of data receivable by said wireless receiving device or an amount of time allowable for receiving the wireless signal by said wireless receiving device based on an electric power level when electric power sufficient to activate said load devices is charged by said electric power charging device, and adds the calculated amounts to said results.

4. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals, a wireless receiving device which receives wireless signals from said wireless communication device;

wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated;

wherein said electric power generator starts generating electricity in response to an output of an environment generating device for applying generating conditions predicted as the environment during generation of electricity.

5. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals;

a wireless receiving device which receives wireless signals from said wireless communication device;

wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated;

wherein said electric power generator starts generating electricity in response to an output of an environment generating device for outputting a sound wave or an ultrasonic wave with a frequency identical to a frequency of vibration during generation of electricity.

6. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals, a wireless receiving device which receives wireless signals from said wireless communication device;

wherein the sensor unit, processing device, wireless transmitting device and wireless receiving device, are activated intermittently using electric power charged by said electric power charging device, said sensor unit, processing device, wireless transmitting device and receiving device being load devices of the electric power charging device; and wherein said wireless receiving device is activated after the transmitting device is activated;

wherein said wireless transmitting device transmits wireless signals to said wireless communication device by a communications method different from that of said wireless receiving device.

7. A wireless communication function equipped sensor comprising:

a sensor unit comprising at least one physical quantity detection device, which detects a physical quantity of a detection object;

an electric power generator;

an electric power charging device which is charged by electric power generated by said electric power generator;

a processing device which processes detection results from said at least one physical quantity detection device;

a wireless transmitting device which transmits said detection results to a wireless communication device by wireless signals;

a wireless receiving device which receives wireless signals from said wireless communication device;

wherein the sensor unit, processing device, wireless transmitting device and wireless receiving device, are activated intermittently using electric power charged by said electric power charging device, said sensor unit, processing device, wireless transmitting device and receiving device being load devices of the electric power charging device, and wherein said wireless receiving device is activated after the transmitting device is activated;

wherein said wireless transmitting device transmits wireless signals to said wireless communication device by the UWB communications method and, said wireless receiving device receives wireless signals from said wireless communication device using any of FM, AM or infrared communications methods.

* * * * *